US006149083A

United States Patent [19]

McFarland

[11] Patent Number: 6,149,083

[45] Date of Patent: Nov. 21, 2000

[54] MACHINE AND METHOD FOR SEPARATING COMPOSITE MATERIALS

[76] Inventor: A. Rae McFarland, 84 High Country Rd., Herriman, Utah 84065

[21] Appl. No.: 09/237,437

[22] Filed: Jan. 26, 1999

[51] Int. Cl.[7] ..... B02C 18/30

[52] U.S. Cl. ..... 241/82.5; 241/186.5; 241/247; 241/260.1

[58] Field of Search ..... 241/82.5, 186.5, 241/247, 260.1, 82.1, 24.1, 24.12, 27, 36

[56] References Cited

U.S. PATENT DOCUMENTS

| | | | |
|---|---|---|---|
| Re. 33,752 | 11/1991 | Poss | 241/74 |
| 3,739,994 | 6/1973 | McFarland | 241/74 |
| 4,566,640 | 1/1986 | McFarland et al. | 241/74 |
| 5,443,214 | 8/1995 | Lesar | 241/82.2 |
| 5,452,650 | 9/1995 | Lee | 241/260.1 X |
| 5,580,305 | 12/1996 | McFarland | 452/138 |

*Primary Examiner*—John M. Husar

*Attorney, Agent, or Firm*—Mallinckrodt and Mallinckrodt; Philip A. Mallinckrodt; Robert R. Mallinckrodt

[57] ABSTRACT

A combination of screening structure for a composite usually food material made up, for example, of a relatively soft flesh component to be recovered and of relatively hard components usually disposed of as waste, and of dual material conveying and discharging screws having overlapped and intermeshed helical flights as discharge structure for the relatively hard components which provide a running series of compartments for receiving, carrying, and discharging such relatively hard components as well as providing useful back pressure on the composite material travelling along and against the entry face of the screening structure. Termination of the overlapping relationship of the helical flights of the material conveying screws within a discharge area for the relatively hard material carried by such compartments facilitates discharge of such relatively hard material. The screening structure may be a flat screen usually of disc configuration, or a tubular screen within which a material conveying auger screw rotates.

12 Claims, 5 Drawing Sheets

MACHINE AND METHOD FOR SEPARATING COMPOSITE MATERIALS

BACKGROUND OF THE INVENTION

1. Field

The invention is in the field of machines and methods for separating usually unwanted components, such as pieces of bone, heavy connective tissue, and skin, or the pits, stems, and seeds of various fruits and berries, from the desired flesh of various composite materials, such as the relatively soft flesh of red meats, poultry, and fish, or the flesh of various fruits, berries, vegetables, and other food items.

2. State of the Art

In the processing of various kinds of meat for food, machines have been developed for a variety of purposes. A primary concern in such processing has been to leave in the meat as little as possible of relatively hard, inedible components, such as pieces or particles of bone, heavy connective tissue, and skin, as in the processing of chunks cut from carcasses of various animals for grinding into hamburger meat or the like, or in the processing of skeletal remains of poultry, especially chicken or turkey, to recover the small amount of flesh remaining attached to the skeletal bones following removal of as much of the flesh as possible by cutting and stripping from the bone.

A type of grinding machine that is widely used throughout the world in the production of hamburger meat, comprises a perforate screening plate of flat and usually disc formation usually having a rotary knife operable at and over the entry face thereof into which the meat material is fed. A flow channel may extend across the entry face of such a screening plate for collecting bones and other relatively hard matter as pushed across such entry face by the rotating knife, which not only scrapes the bone and other relatively hard matter from the entry face of the screening plate toward discharge therefor but also tends to push flesh through the screen openings, see Speco, Inc.'s Charles W. Hess U.S. Pat. No. 4,004,742 of Jan. 25, 1977.

Other machines widely used for processing skeletal remains of poultry, especially chicken, are known as "deboning" machines in accordance with Beehive Machinery, Inc.'s Archie R. McFarland U.S. Pat. No. 3,739,994 of Jun. 19, 1973, as reissued on Jul. 17, 1984 as Re. 31,631, the Claudio dos Santos U.S. Pat. No. 4,189,104 of Feb. 19, 1980, and the McFarland et al. U.S. Pat. No. 4,340,994 of Jul. 27, 1982, U.S. Pat. No. 4,480,980 of Nov. 6, 1984, and U.S. Pat. No. 4,566,640 of Jan. 28, 1986.

A later machine developed by Archie R. McFarland for Diamond Stainless Corporation of Salt Lake City, Utah, is disclosed in U.S. Pat. No. 5,580,305 of Dec. 3, 1996 for "Segregating Meat from Bone, Heavy Tissue, and Skin". This machine operates primarily on chunks of cut meat that include sizeable pieces of bone and often heavy connective tissue and skin.

Although the early deboning machines provide for the build-up of a so-called "filter mat" across the inner face of a tubular screen through which the feed material is advanced by a conveyor screw for filtering out small particles of bone from the flesh about to pass through the screen, the McFarland machine of U.S. Pat. No. 5,580,305 is not concerned with such a filter mat. Rather it increases production of the relatively soft product while effectively dealing with relatively large pieces of bone usually contained by the chunks of cut meat. There, a conveying cutter helical screw or auger is provided in close cutting relationship with the perforations of the usual cylindrically tubular screen in combination with a bone-cutting ring valve at the discharge end of such screen, which provides advantageous back pressure within the tubular screen as does the ring valve of a usual deboning machine.

An older McFarland U.S. patent assigned to Beehive Machinery, Inc. is U.S. Pat. No. 3,825,231 of Jul. 23, 1974 entitled "Twin Screw Continuous Processing Machine". It discloses twin helical screws at the bottom of a hopper for mixing meat materials in the hopper and for discharging the mixed material into the entry face of a flat disc grinder screen, with anything that does not pass through the screen falling back into one of the screws for transfer to the other screw for further mixing.

There are two additional prior art patents, one U.S. Pat. No. 5,443,214 of Aug. 22, 1995, inventor Nick J. Lesar, entitled "Hard Material Collector Assembly for a Grinder", and issued to Assignee Weiler and Company, Inc. of Whitewater, Wis., cites both the previously mentioned McFarland U.S. Pat. No. 3,739,934 and Hess U.S. Pat. No. 4,004,742; the other one is U.S. Pat. No. 5,452,650 of Sep. 26, 1995 for "Juice Extractor" issued to Korean inventor Mun-Hynn Lee.

SUMMARY OF THE INVENTION

A principal object in the making of the present invention was to effectively discharge pieces of bone and other relatively hard components that accompany cut pieces of meat or other materials fed to a processing machine, substantially without the grinding or cutting of such relatively hard components as occurs in present grinder screen machines or as occurs in the other machines of the above-mentioned patent.

This is preferably accomplished by utilizing the first of the aforementioned types of processing machines, i.e., one having a flat plate grinder screen with a rotary knife active on the entry face of the screen, rather than a tubular screen with material conveying, helical screw or auger. The rotary knife is preferably one with multiple blades radiating from a central shaft for pushing pieces of relatively hard material against and across the flat entry face of the flat plate screen as confronted by the blades of the rotary knife. As in the aforementioned Speco, Inc.'s Hess U.S. Pat. No. 4,004,742, such a screen may be provided with a bone-receiving and guiding flow channel, or one with a circumferentially-directed channel as presently used in generally similar machines, but, in accordance with the present invention, in combination with a special back-pressure-providing discharge device which effectively receives and removes the pieces of bone and of other relatively hard material, if present, substantially without cutting it.

I have found that discharging of relatively large pieces of bone and the like into the entry end of dual, elongate, material-conveying, helical screws, that have their spiral flights over-lapped and intermeshed to form a longitudinally running series of bone-carrying compartments each being of length capable of accepting unusually long pieces of bone and other relatively hard and normally unwanted material or even relatively small pieces of material, such as berry seeds accompanied by liquid, the size of the compartments being adjustable by substitution of different helical screws having the pitch of the helical threads suitably altered. Moreover, the carrying capacity of the dual helical screws can be altered by changing their rate of rotation. I have found that the longitudinally running, overlapped and intermeshing flights provide not only for very effective carrying of unusually long bones, etc., but, also, for back-pressurizing the material being screened as previously done by a bone-cutting ring valve at the discharge end of a tubular screw in accordance with the aforementioned McFarland U.S. Pat. No. 5,580,305.

Thus, the overlapping, double helical screw, discharge device acts as a rotary valve and can be used in combination with either a flat screen or a tubular screen for separating components of a variety of composite materials.

THE DRAWINGS

The best mode of each of different ways presently contemplated for carrying out the invention is illustrated in the accompanying drawings, in which:

FIG. 1 represents a view in longitudinal side-elevation of a meat grinding machine of the invention, shown partially in axial vertical section revealing the overlapped and intermeshed, material-discharging, helical screws in combination with a flat disc grinder screen;

FIG. 2, a view in horizontal section taken along the line 2—2 of FIG. 1 and otherwise being in top plan;

FIG. 3, an isometric view of the machine of FIGS. 1 and 2 drawn to somewhat larger scale and having a longitudinal portion cut away to reveal the overlapping helical screws and other internal parts;

FIG. 4, a pictorial exploded view showing the various parts of the machine of the preceding figures in series arrangement extending from the flat disc grinder screen through the material-discharging dual screws; and FIG. 5, a view corresponding to that of FIG. 1 but showing a different embodiment of the invention wherein the material-discharging screws are combined with, a tubular screen having a cutting auger for moving the material along the interior cylindrical face of the screen.

DETAILED DESCRIPTION OF THE ILLUSTRATED EMBODIMENTS

Figure 1:
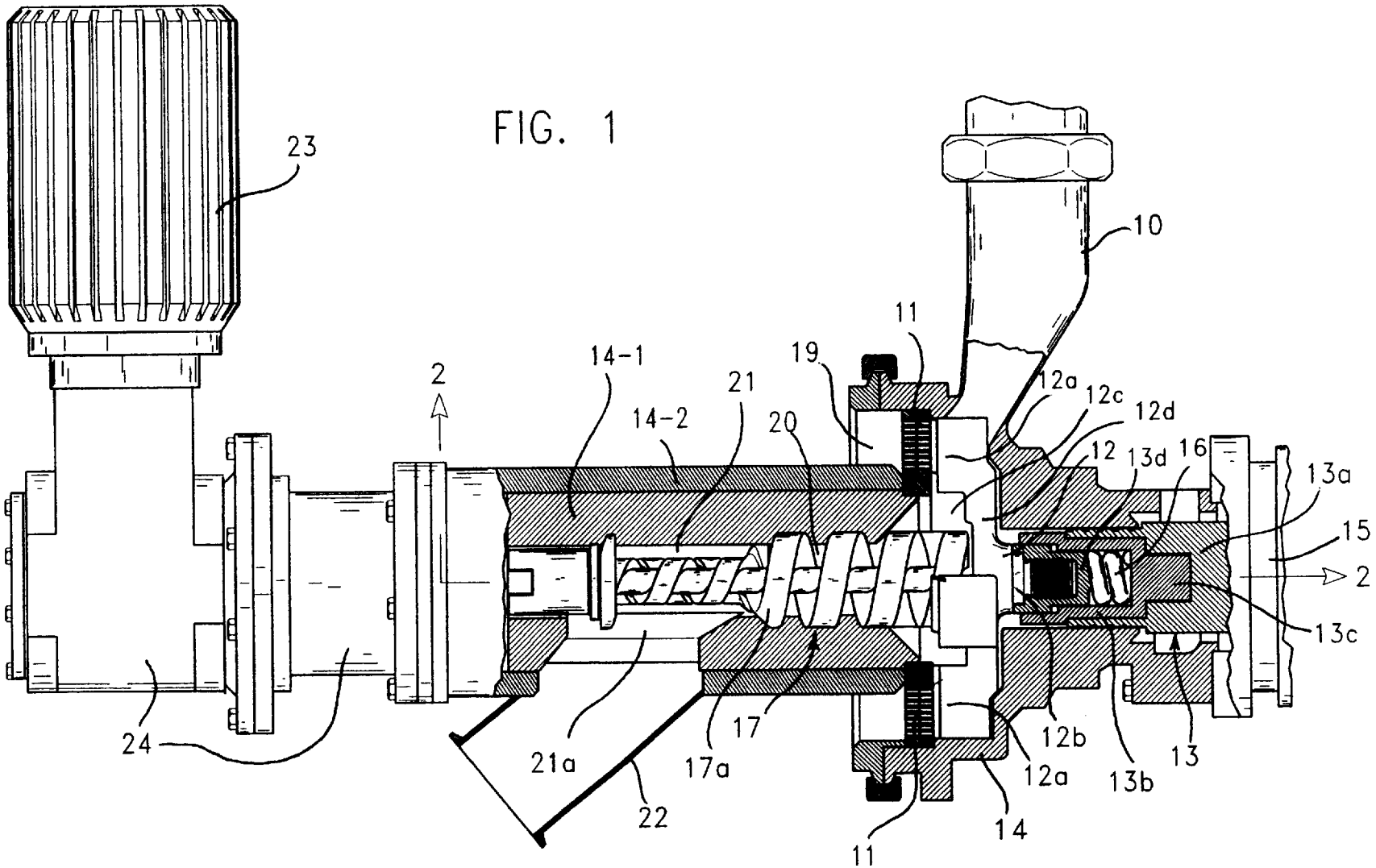
Figure 2:
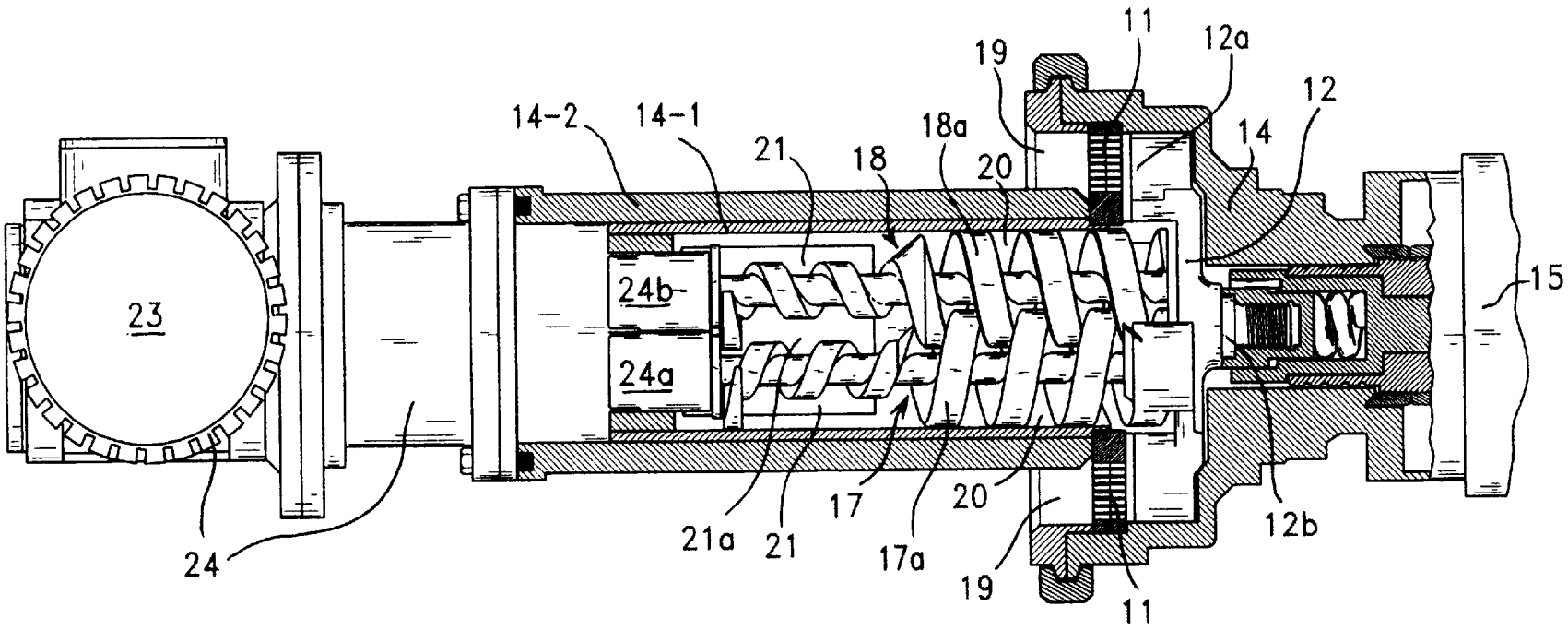
Figure 3:
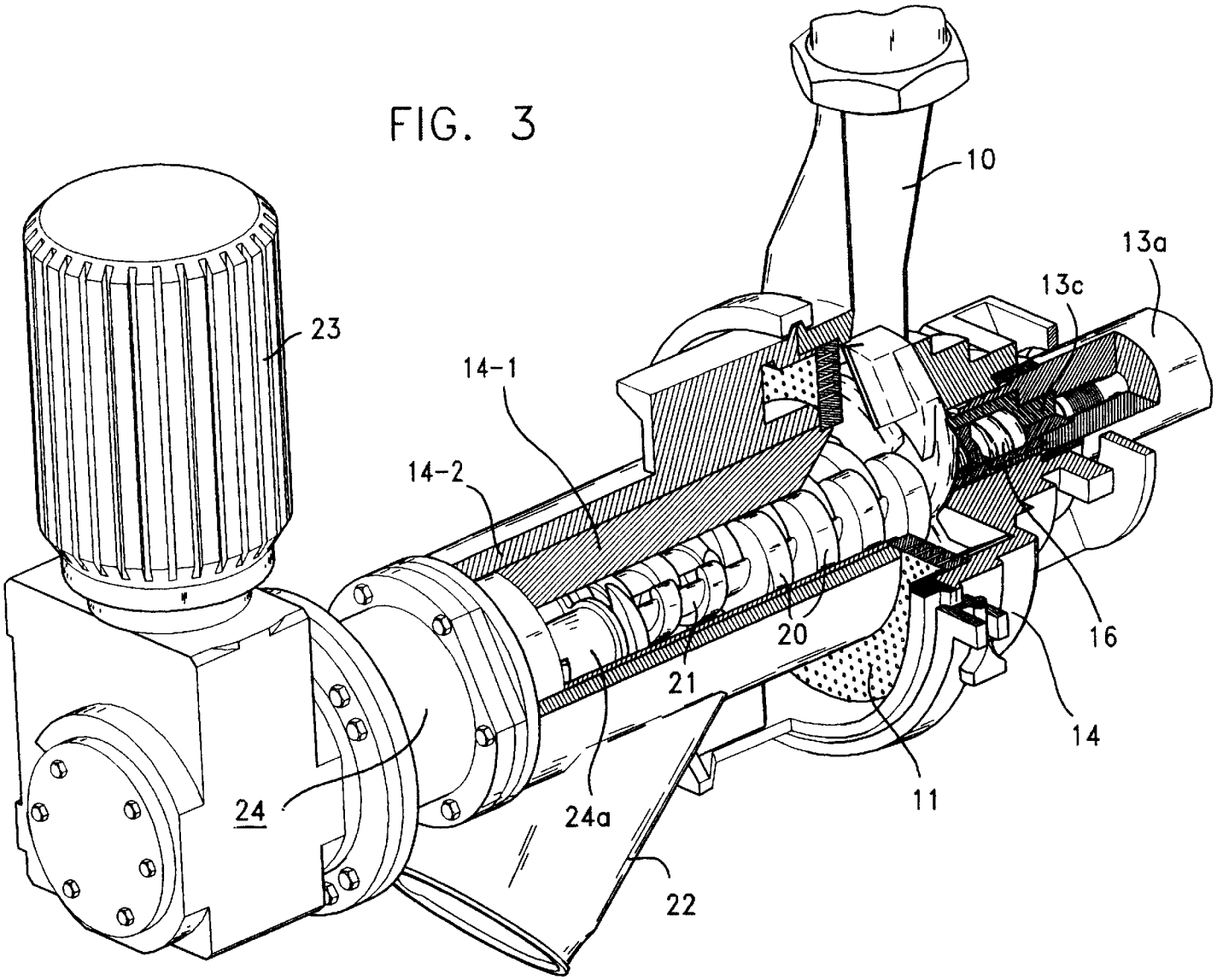
Figure 4:
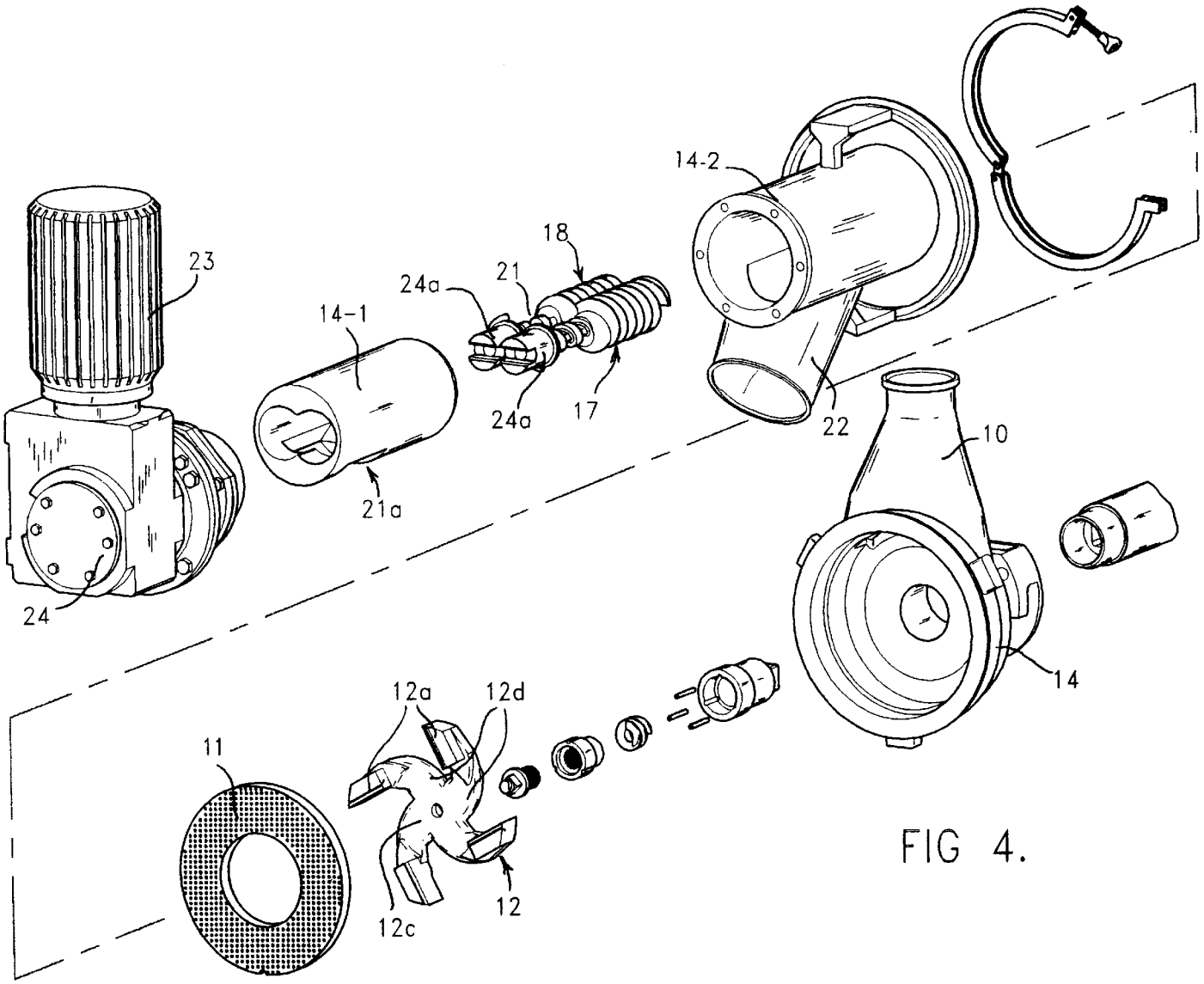

In the form of the invention illustrated in FIGS. 1–4, a composite material, such as lumps of cut meat having relatively soft flesh together with pieces of bone and other relatively hard components such as connective tissue and skin, or such as fruit having relatively soft flesh together with pits, stems, seeds or other normally waste parts, is fed from a source of same through a tubular hopper 10, shown fragmentarily in FIG. 1, usually under pumping pressure or by a helical screw or auger driven in any suitable manner. Hopper 10 empties across the entry face of a vertically positioned, flat plate grinder screen 11 against which the blades 12*a* of a multibladed, rotary knife 12 extend radially, or otherwise angularly, from rigid mounting of such knife on a drive shaft assembly 13 in a casing 14 and driven in any suitable manner, as by a variable speed motor 23 operating through a standard gearbox 15. Drive shaft assembly 13, as illustrated in FIGS. 1, 2, and 3, comprises a rotatable shaft part 13*a* coupled to the output shaft of the gearbox 15, a second rotatable shaft part 13*b*, coupled by a square or other polygonally shaped end member 13*c* to rotatable part 13*a* and having an opposite, annular end portion into which fits, rotatably and movably longitudinally, a shaft part 13*d*. Into the open annular end of such shaft part 13*d* is screwed a shaft portion 12*b* of rotary knife 12, so that knife 12 is rotated by its connection with gearbox 15 but is also constantly pressed forwardly by a spring 16 housed within shaft part 13*b* to take up any slack due to knife blade wear.

In grinding chunks of, for example, cut meat containing or otherwise associated with pieces of bone and usually with pieces of heavy connective tissue and skin, such composite material is passed from hopper 10 onto the entry face of meat grinder screen 11 into the path of the rotating blades 12*a* of knife 12, where they are pushed against and across such entry face of the screen and dropped into the central recess 12*c* of the rotary knife 12 and into the entry end of a rotary valve discharge structure provided by dual, intermeshing, helical screws 17 and 18, FIG. 2, that are rotatably mounted within a casing 14-1 that extends internally of a casing 14-2 which itself extends from screen 11. Such material conveying screws 17 and 18 correspond to prior art, dual, intermeshing, helical, material conveying screws 80 and 82, FIG. 5, of the screw pump 50 of the previously mentioned McFarland et al. patent, U.S. Pat. No. 4,566,640, issued to Beehive Machinery, Inc. on Jan. 28,1986, but are material discharging screws in the present invention rather than material infeed screws in the prior et al. patent. The flesh passes through the perforations of screen 11 and, as here shown, into an annular, open discharge chamber 19, from where it is discharged into a receiving vessel (not shown) as a valuable ground meat product of the operation.

As here shown and preferably, each blade 12*a* of the rotary knife 12 is mounted so as to collectively define the recessed or dish nature of the knife, usually angularly with respect to the substantially radial sweep of the carrying arms 12*d* of the knife so the sharp cutting edges of the respective blades move in fiber-cutting relationship with the entry openings of the screen.

Since the chunk material to be subjected to separation of the soft flesh thereof from the relatively hard components thereof is introduced into the recess 12*c* of the knife in advance of the entry face of the screen, usually under pumping pressure, the flesh readily passes through the screen, while the large pieces of bone and other relatively hard material are pushed along the entry face of the screen substantially without being cut prior to passing into the entry ends of conveying screws 17 and 18, whose helical flights 17*a* and 18*a* are overlapped to provide longitudinally running and bone-receiving compartments 20, FIGS. 1 and 3, the helical pitch of such screws 17 and 18 being great enough to accommodate the anticipated maximum length of pieces of bones and other hard materials that are associated with the chunks of meat in the composite material to be ground.

The spiral flights 17*a* and 18*a* of the helical, material-carrying screws 17 and 18 are reduced in diameter along a discharge section 21, usually the end portions of such screws, so as to substantially not overlap and to therefore provide an elongate opening 21*a* FIG. 2 between the still helical portions of the screws for facilitating release and dropping of the carried bone and other hard materials into offtake chute 22, FIG. 1.

The helical, material-carrying screws 17 and 18 are rotated in opposite directions toward each other by preferably a speed-adjustable motor 23 and appropriate the gear box 24 with respective screw-coupling, out-put shafts 24*a* and 24*b*, FIG. 2.

Figure 5:
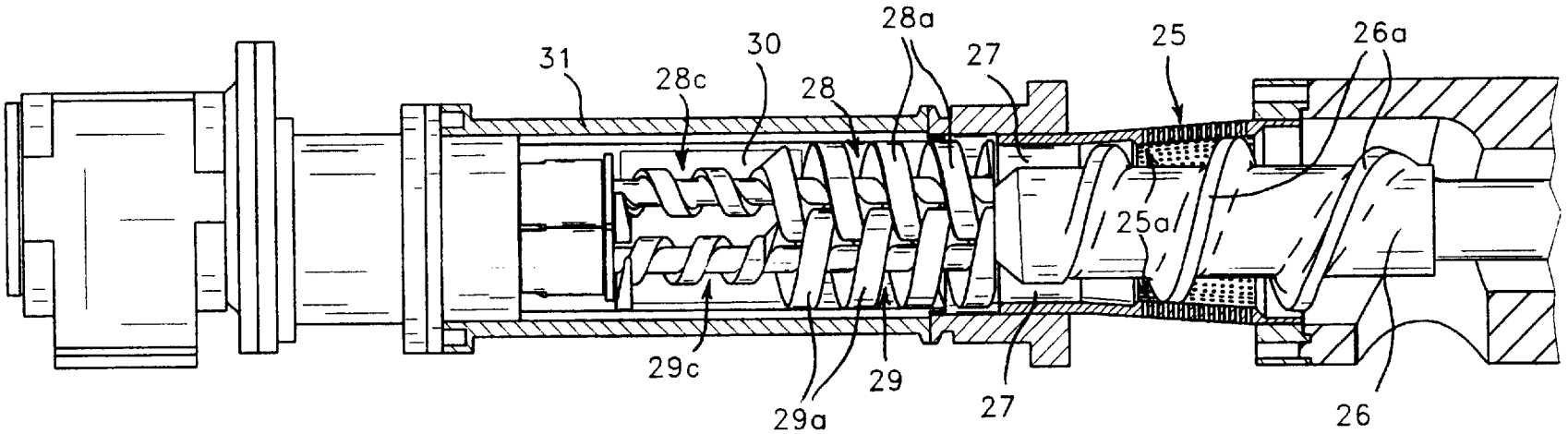

As previously indicated, the screen may be tubular, as shown at 25, FIG. 5, preferably converging toward its discharge end 25*a* so as to be somewhat conical, whereby an auger screw 26 with a helical, cutting flight 26*a* is continually pressed against the inner cylindrical entry face thereof.

The relatively soft flesh component of the composite material being processed passes through the perforations of screen 25, while the relatively hard components are carried by helical flight 26*a* of auger screw 26 through annular passage 27 into the entry end portions of the dual, helical, conveying screws 28 and 29, whose flights 28*a* and 29*a* overlap up to non-overlapped, discharge end portions 28*c* and 29*c* of such helical screws 28 and 29 which overlie a discharge opening 30 in a casing 31, within which the helical, material conveying screws 28 and 29 are rotatably mounted, thereby producing the entrance to a discharge conduit (not shown) that may correspond to the offtake conduit 22 in the embodiment of FIGS. 1–4.

It should be realized that here, as in the first embodiment of the machine of this invention, the dual helical, conveying screws 28 and 29 produce back pressure on the composite material being conveyed.

It should be realized that the material conveying and mixing machine of my aforementioned patent, U.S. Pat. No. 3,825,231, is not only structurally different from the present machine in that the helical screws do not overlap to provide longitudinally running, material-carrying compartments between them, which receive their contents from the blade-scraped entry face of the screen and carry them to remote discharge at the opposite ends of such compartment-forming screws, but that the individual placement and operation of the structure effect different results from that of the present machine. Moreover, the dual, overlapped, helical, material conveying screws of the McFarland et al. U.S. Pat. No. 4,562,640, feed the composite material to the seperating screen rather than discharging bone from the machine.

Whereas this invention is here illustrated and described with reference to embodiments thereof presently contemplated as the best modes of carrying out such invention in actual practice, it is to be understood that various changes may be made in adapting the invention to different embodiments without departing from the broader inventive concepts disclosed herein and comprehended by the claims that follow.

I claim:

1. A machine for separating different components of a composite material, comprising screen structure whose screen has entry and discharge faces; means for placing the composite material at the entry face of the screen; means for passing and pressing said composite material along and against said entry face of the screen for passage of a component thereof through said screen; elongate, rotary discharge structure having an entry end portion located at or near said entry face of the screen for receiving material that does not pass through the screen and having an elongate material discharging section for material that does not pass through the screen but that is part of said rotary discharge structure; said rotary discharge structure comprising dual, elongate, helical conveying screws having respective longitudinal helical flights that overlap and whose pitch is such as to provide a series of travelling compartments for accommodating said material that does not pass through the screen and for carrying it to said discharging section of said rotary discharge structure, said elongate material discharging section having dual conveying screws that substantially do not overlap.

2. A machine according to claim 1, wherein the helical flights of the respective conveying screws substantially terminate their overlapping relationship substantially at their entry to the elongate, material discharging section thereof to facilitate discharge of the material that does not pass through the screen.

3. A machine according to claim 1, wherein the screen structure is a substantially flat grinder screen, and wherein the means for passing and pressing the composite material along the entry face of the screen is a rotary knife having cutting blades bearing against the entry face of the screen.

4. A machine according to claim 3, including spring structure communicating with the rotary knife to continually maintain cutting pressure of the blades against the screen as the knife rotates.

5. A machine according to claim 1, wherein the screen structure is tubular with the entry face thereof being its interior face; and wherein the means for passing and pressing the composite material along the entry face of the screen is a helical material conveying screw within said tubular screen and extending along the said entry face thereof.

6. A machine according to claim 5, wherein the helical conveying screw has a running, longitudinal, cutting flight bearing against the entry face of the screen.

7. A machine according to claim 6, wherein the tubular screen converges from an entry portion thereof to a discharge portion thereof, and wherein means are provided to continually force the helical flights in close cutting relationship with the entry face of the screen.

8. A machine according to claim 1, wherein the component material operated upon by the machine contains relatively hard and relatively soft material for separation one from the other.

9. A machine according to claim 1, further comprising means for rotating the dual, elongates, helical, material conveying screws of the discharge structure, said means including a variable speed motor.

10. A method of separating different components of a composite material, comprising feeding the composite material into a machine constructed according to claim 9; operating said machine to separate and separately discharge components of said composite material; and varying the speed of the motor in accordance with the requirements for output, depending upon the composite material being operated on by the machine.

11. A method in accordance with claim 10, wherein the component material contains relatively hard and relatively soft material for separation one from the other.

12. A machine according to claim 1, wherein the rotary discharge structure includes a casing within which the dual, elongate, helical conveying screws are mounted for rotation, said casing having a material discharge opening below the elongate material discharging section of said rotary discharge structure.

* * * * *